US009687119B2

(12) United States Patent
Adamson et al.

(10) Patent No.: US 9,687,119 B2
(45) Date of Patent: Jun. 27, 2017

(54) FRAMELESS SHOWER IMPLEMENT HAVING GROOVED SURFACING

(71) Applicants: Kolby Adamson, Lehi, UT (US); Cory Thomas, Pleasant Grove, UT (US)

(72) Inventors: Kolby Adamson, Lehi, UT (US); Cory Thomas, Pleasant Grove, UT (US)

( * ) Notice: Subject to any disclaimer, the term of this patent is extended or adjusted under 35 U.S.C. 154(b) by 517 days.

(21) Appl. No.: 14/020,815

(22) Filed: Sep. 7, 2013

(65) Prior Publication Data

US 2015/0067961 A1 Mar. 12, 2015

(51) Int. Cl.
*A47K 3/40* (2006.01)

(52) U.S. Cl.
CPC ..... *A47K 3/405* (2013.01); *A47K 3/40* (2013.01); *Y10T 29/49826* (2015.01)

(58) Field of Classification Search
CPC ..... A47K 3/28; A47K 3/40; A47K 3/405
USPC ..... 4/596, 609, 612–614, 679; 52/34, 35
See application file for complete search history.

(56) References Cited

U.S. PATENT DOCUMENTS 2,757,385 A * 8/1956 Whittick ..... A47K 3/281 4/613
4,551,870 A * 11/1985 Presti, Jr. ..... A47K 3/40 4/612
4,557,004 A * 12/1985 Piana ..... A47K 3/40 4/596
5,159,723 A * 11/1992 Benedict ..... A47K 3/008 4/538
5,778,464 A * 7/1998 Chapple ..... A47K 3/008 4/584
5,913,777 A * 6/1999 Gerber ..... A47K 3/40 4/596
6,647,565 B2 * 11/2003 Smale ..... E04F 15/02 4/584
6,735,793 B2 * 5/2004 Peterson ..... A47K 3/40 4/596
7,562,495 B1 * 7/2009 Fairchild ..... A47K 3/40 4/613
8,181,288 B1 * 5/2012 Davis, Jr. ..... A47K 3/40 4/613
2008/0276364 A1 * 11/2008 Barro ..... A47K 3/40 4/613
2010/0071125 A1 * 3/2010 Miller ..... A47K 3/40 4/613
2010/0218310 A1 * 9/2010 Schindler ..... A47K 3/1605 4/613

* cited by examiner

*Primary Examiner* — J. Casimer Jacyna
(74) *Attorney, Agent, or Firm* — Steven Rinehart

(57) ABSTRACT

A shower pan installation kit is disclosed comprising a hexahedrial polymeric curb and a tray having one or more graded or concave panels defining a recess for a drain. The inward surface of the curb is recessed inward and upward. This recess, or groove, is for receiving a waterproof membrane overlaid and overlapping the tray for improvement of the waterproof barrier underlaying the shower pan constructed above the kit.

5 Claims, 5 Drawing Sheets

FRAMELESS SHOWER IMPLEMENT HAVING GROOVED SURFACING

BACKGROUND OF THE INVENTION

Field of the Invention

This invention relates to showers, and more particularly relates to prefabricated shower tray and curbs for use in installing a shower pan.

Description of the Related Art

Shower pans used in the installation of showers in residential and commercial construction applications have been known in the art for decades. Shower pans slope inwardly and are required for proper water flow to a centrally-located drain. Most local building codes require shower pans.

Traditionally, mortar beds have been built on a subgrade for supporting the pan. Additionally or alternatively, shower frames have been constructed from wooden curbs and ramps to hold the pan. The components of the frame may abut one another but are not waterproof in the art. These curb-ramp assemblies server as little more than bases upon which other shower components forming the pan rest or are affixed, including mortar waterproofing membranes and tile.

Although there are shower substrates/frames fabricated from polymeric products known in the art which are supplied to contractors for improving the efficiency shower installation, these substrates suffer from many of the same defects and inefficiencies as mortar beds, including a propensity to leak, or seap, water through the bed/substrate components abutting one another into underlying wooden or steel members.

Traditional kits do not provide means of efficiently preventing leakage and provide no means of grading surfaces beyond the curb and tray abutment points. It is therefore desirable that a kit, tray or substrate assembly be provided with enhances waterproofing and pan installation.

SUMMARY OF THE INVENTION

From the foregoing discussion, it should be apparent that a need exists for a frameless polymeric shower implement for constructing a shower pan. Beneficially, such a apparatus would overcome many of the difficulties with prior art by providing a means for more efficiently waterproofing a shower pan.

The present invention has been developed in response to the present state of the art, and in particular, in response to the problems and needs in the art that have not yet been fully solved by currently available methods and apparati. Accordingly, the present invention has been developed to provide a shower pan installation kit comprising: a tray comprising one or more polymeric panels, each panel having a planar bottom surface and inwardly sloping graded top surface, wherein the tray defines a circular recess for receiving a drain; a polymeric curb having a planar inward surface and planar bottom surface; wherein the curb defines an upwardly rising groove recessed into the curb such that the groove rises from a lower point on the inward surface to a higher end point within the curb, the groove for subsequently receiving a waterproof membrane overlaying the tray; wherein an outer edge of the one or more polymeric panels rises through a distance from the panel's bottom surface to the top surface that is equal to a height of the lower point above the curb's bottom surface; and wherein the outer edge of the panel and inward edge of the curb abut one another.

The panels and curbing may be adhered one to another. The curb and paneling may be fabricated from polystrene. The curb and paneling may be fabricated from wood.

In some embodiments, the groove rises upwardly at between 10 degrees and 70 degrees off horizontal.

A second shower pan installation kit is also disclosed comprising: a tray comprising a polymeric panel having a planar bottom surface and inwardly sloping concave top surface, wherein the tray defines a circular recess for receiving a drain; a polymeric hexahedrial curb having a planar inward surface and planar bottom surface; wherein the curb defines an upwardly rising groove recessed into the curb such that the groove rises from a lower point on the inward surface to a higher end point within the curb, the groove for subsequently receiving a waterproof membrane overlaying and overlapping the tray; wherein an outer edge of the panel rises through a distance from the panel's bottom surface to the top surface that is equal to a height of the lower point of the curb above the curb's bottom surface; and wherein the outer edge of the panel and inward edge of the curb abut one another.

A method installing a shower pan during shower construction, the steps of the method comprising: recessing an upwardly rising groove into an inward surface of a hexahedrial curb; abutting the inward surface of the curb against an outer surface of a polymeric graded tray, such that a top surface of the tray sits flush with a bottom surface of the groove; overlaying and overlapping a waterproof membrane on the tray such that an overlapping portion of the waterproof membrane extends laterally into the groove defined by the curb; and constructing the shower pan above the tray and curb.

The method may further comprise adhering the tray to the curb. The method may further comprise constructing a mortar subsurface over the tray and curb.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
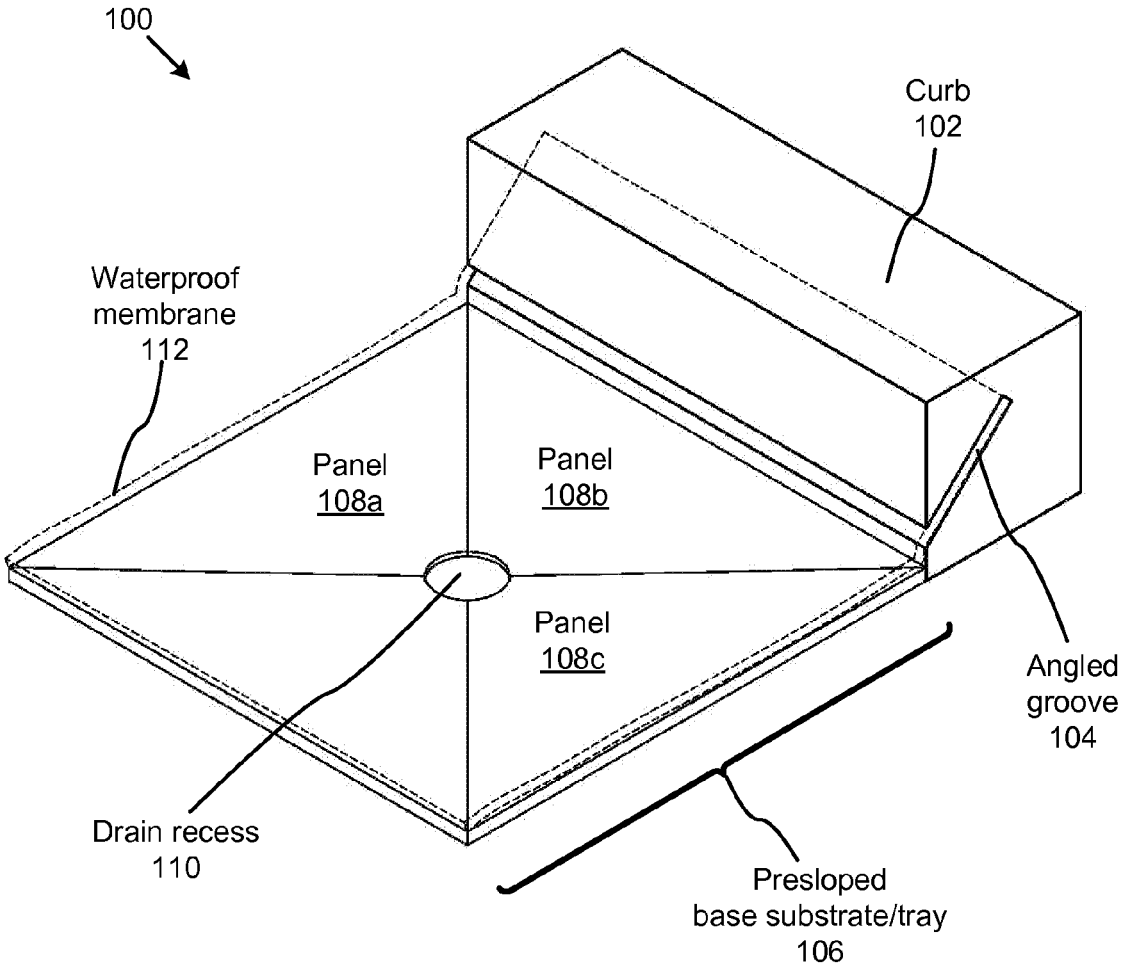
FIG. 1 is a side elevational perspective environmental view of a shower pan installation kit in accordance with the present invention.

FIG. 1 is a side elevational perspective environmental view of a shower pan installation kit 100 in accordance with the present invention. The shower pan kit comprises a curb 102 having an angled groove 104 upwardly rising from the curb's inner surface.

In various embodiments of the present invention, the curb 102 is cubic, cuboid or hexahedrial. The curb 102 has a planar bottom surface and a planar inner surface. In some embodiments of the present invention, the kit 100 comprises a plurality of curbs 102 sitting adjacent to and/or in line with one another.

In various embodiments of the present invention, the curb and/or panels 104*a-d* are formed from polystyrene, wood, metal alloys, or other polymeric or elastomeric materials.

The curb 102 defines a recess, or groove 104, rising upwardly from the inner surface through the curb 102. This groove 104 is typically an angle-cut, largely planar recess carved or milled into the curb 102 such that the groove 104 rises from a predetermined height on the inner surface of the curb 102 at between 10 and 70 degrees of horizontal through the curb a predetermined distance.

The predetermined height of the groove 104 start point is predetermined to correspond to a thickness of the tray 106 and/or panels 108*a-c* forming the tray.

The panels 108*a-c* are typically formed, like the curb 102, from elastomeric, polymeric or foam. The panels 108*a-c* are lightweight and designed to be easily cut or adjusted to meet the needs of a shower installer or laborer.

The tray 106, in some embodiments, is concave such that water runs toward the centrally located point in the tray 106 where a drain is disposed. In various embodiments of the present invention, the tray 106 is formed from a plurality of panels 108*a-c*, each having a planar bottom surface that is not parallel to the panel's 108 top surface. The top surface of the panels 108*a-c* may be graded, or declined toward the drain; or, in various embodiments, concave.

The height of the panels 108*a-c* at their outermost edge is predetermined to correspond to the predetermined height of the groove 104 above the bottom surface of the curb 102.

A panel 108 is position during installation such that it abuts, or sits adjacent to, the inner surface of the curb 102. A waterproof membrane 112 is laid over the tray 106 such that is overlaps the tray 106. The overlapping portion of the waterproof membrane 112 is inserted into the groove 104 of the curb 102.

Figure 2A:
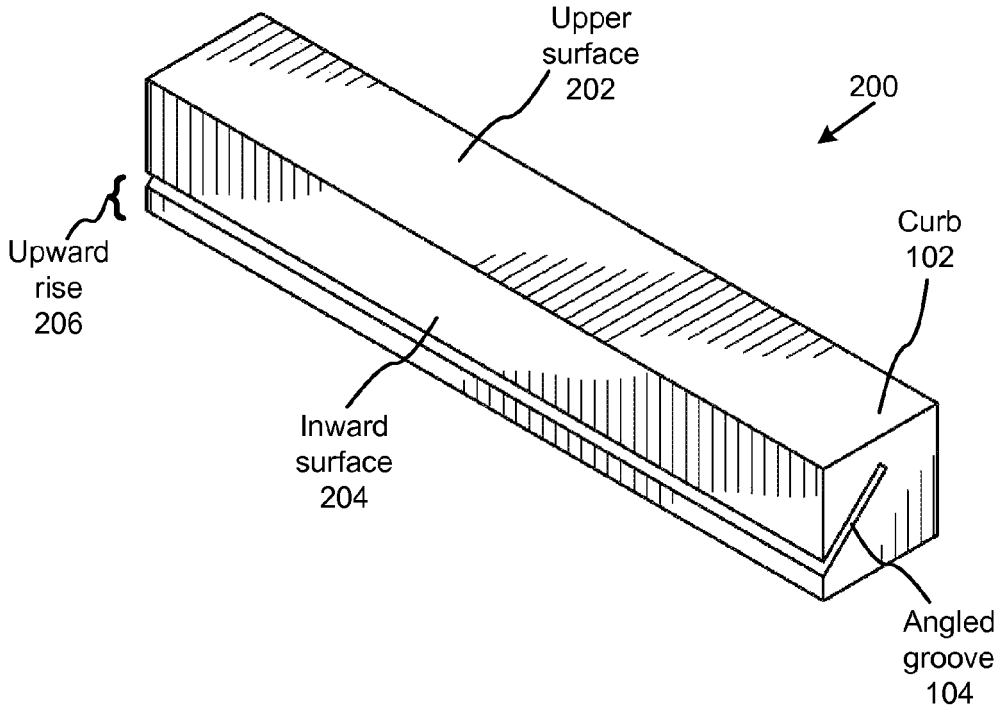
FIG. 2A is a side elevational perspective view of the curb of a shower pan installation kit in accordance with the present invention.

FIG. 2A is a side elevational perspective view of the curb of a shower curb 200 of a shower installation kit in accordance with the present invention. The curb 200 comprises a polystyrene curb 102 and defines an angled groove 104. The curb 200 further comprises an upward surface 202, an inward surface 204, and an upward rise 206.

The inward surface 204 is planar, as is a bottom surface of the curb 200. In various embodiments, the groove 104 is sawed, carved, or cut into the curb 102. The curb 102 may be fabricated from a mold as one integrated piece with the groove 104 defined.

In various embodiments, the groove 104 rises upwardly from the parallel to the bottom surface between 10 and 80 degrees off horizontal. The width of the groove 104 may vary from only a millimeter to seven or more centimeters. In some embodiments of the present invention, the groove 104 curves upward, and is convex in shape rather than linear.

The upward rise 206 is the distance between the bottom surface of the curb 102 and the beginning of the groove 104. This distance is calculated to match or correspond to the thickness of a panel 108 or the tray 106.

Figure 2B:
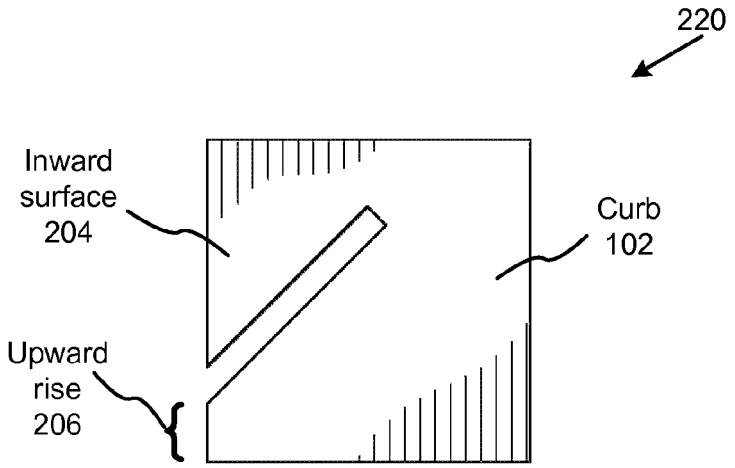
FIG. 2B is a side perspective view of a the curb of a shower pan installation kit in accordance with the present invention.

FIG. 2B is a side perspective view of a the curb of a shower pan installation kit in accordance with the present invention.

This figure further illustrates the same teachings shown in FIGS. 1-2A above.

Figure 3A:
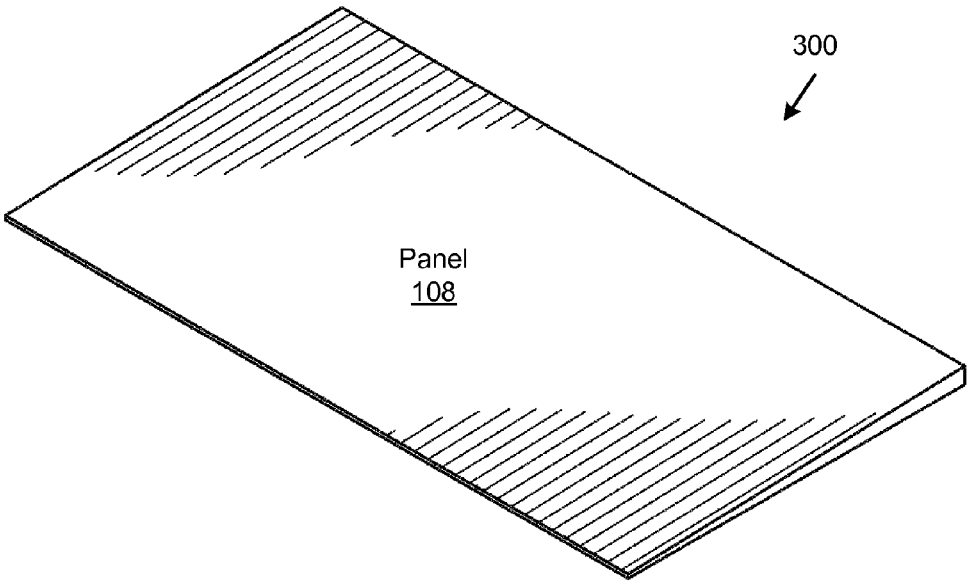
FIG. 3A is a side elevational perspective view of a panel of a shower pan installation kit in accordance with the present invention.

FIG. 3A is a side elevational perspective view of a panel 300 of a shower pan installation kit in accordance with the present invention.

The panel 108 is presloped from a higher thickness to narrower thickness. In various embodiments of the present invention, the panel 108 is cut by installers to contour other panels 108 in the kit 100, or irregular surfaces defining a shower. The panel 108 may be cut diagonally across both it lateral and longitudinal axes to coordinate with other panels 108. In various embodiments, the panels 108*a-d* are adhered together using means known to those of skill in the art. The panel 108 may circular, ovoid, or polygonal, and may be concave across its top surface to direct water to a centrally located point for a drain.

Figure 3B:
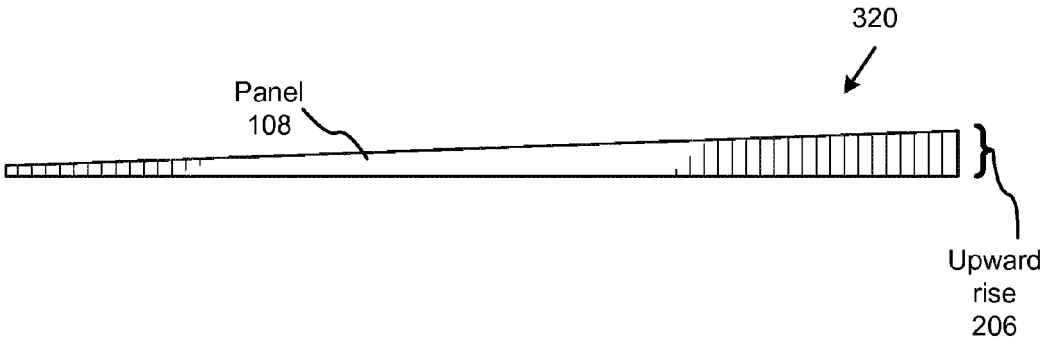
FIG. 3B is a side perspective view of a panel of a shower pan installation kit in accordance with the present invention.

FIG. 3B is a side perspective view of a panel 320 of a shower pan installation kit in accordance with the present invention.

In various embodiments, the panels 108 and/or the tray come prefabricated with the membrane 112 and/or mortar and/or tile affixed to their top surfaces. The membrane 112 may be specially designed to bond to the curb 102 or an adhesive disposed within the groove 104.

The panel 108 is presloped to decline from a thickness matching the upward rise 206 to a more diminished thickness.

Figure 3C:
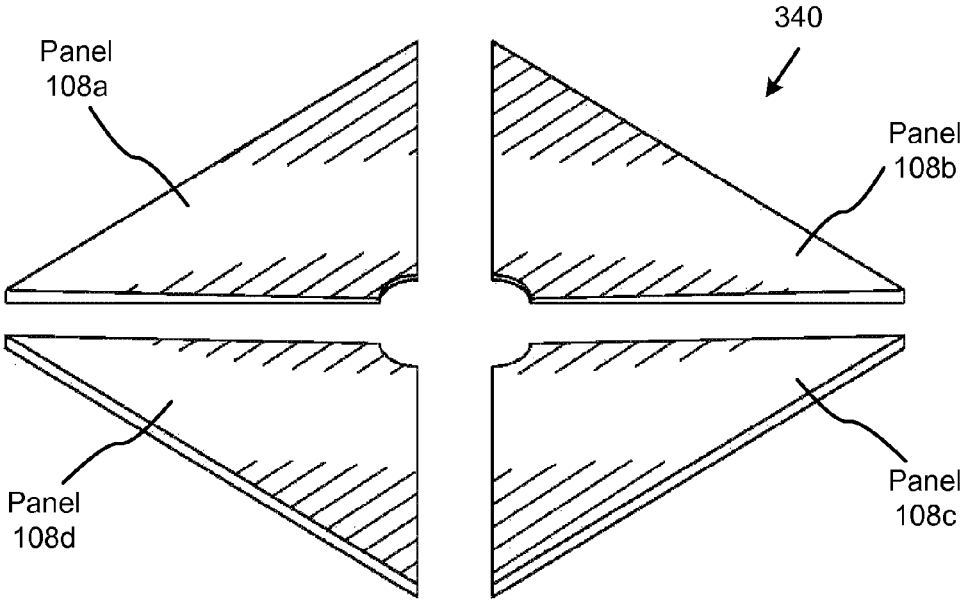
FIG. 3C is an elevational perspective view of the tray of a shower pan installation kit in accordance with the present invention.

FIG. 3C is an elevational perspective view of the tray 340 of a shower pan installation kit in accordance with the present invention. The tray 340 comprises four panels 108*a-d*.

In the shown embodiment, the panels 108*a-d* have been cut diagonally to fit together in x-shape. The panels 108*a-d* have also been cut to define a recess for a drain. A membrane 112 is laid over the panels 108*a-d* and the shower pan is built atop the tray 340.

Figure 4:
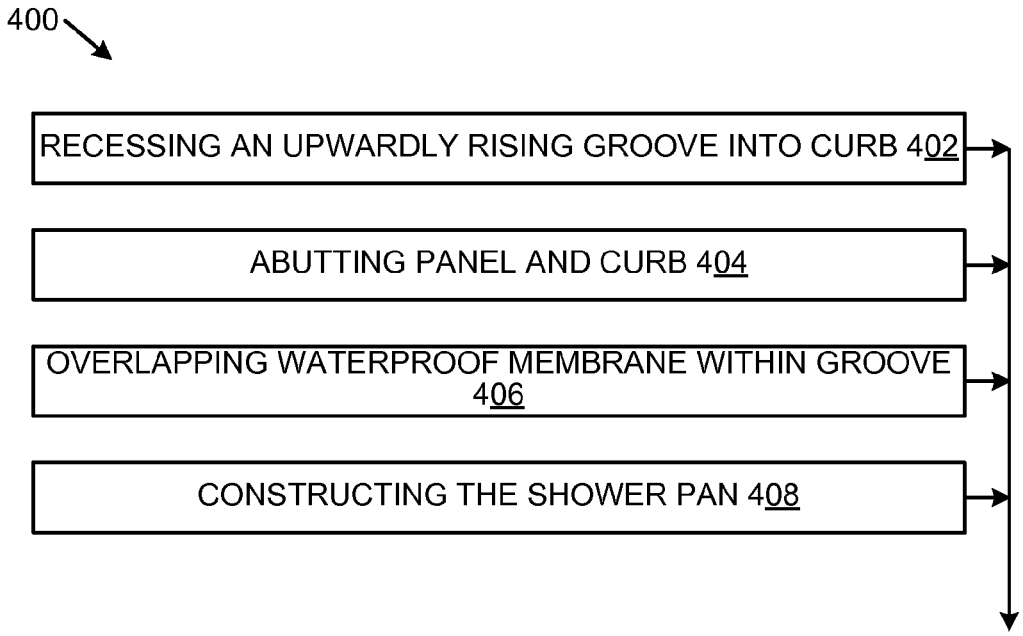
FIG. 4 is a flow chart of the steps of a method for constructing a shower pan in accordance with the present invention.

FIG. 4 is a flow chart of the steps of a method 400 for constructing a shower pan in accordance with the present invention.

The method begins 402 with an upwardly rising groove 104 being cut into a curb 102 at an incline. Next a panel 108 is abutted to the inward surface of the curb 102 such that the top outer surface of the panel 108 matches the upward rise 206 of the curb 102.

A waterproof membrane 112 is laid 406 over the panel 108 such that all or a portion of the membrane 112 overlapping the panel 108 laterally is inserted into the groove 104. The groove 104 receives the membrane 112 and the membrane 112 is adhered to the curb 102 within the groove 104.

Finally, the shower pan is constructed 408 over the top of the panel 108 and the membrane 112.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A shower pan installation kit comprising:

a tray comprising one or more polymeric panels, each panel having a planar bottom surface and inwardly sloping graded top surface, wherein the tray defines a circular recess for receiving a drain;

a polymeric curb having a planar inward surface and planar bottom surface;

wherein the curb defines an upwardly rising groove recessed into the curb such that the groove rises from a lower point on the inward surface to a higher end point within the curb, the groove for subsequently receiving a waterproof membrane overlaying the tray;

wherein an outer edge of the one or more polymeric panels rises through a distance from the panel's bottom surface to the top surface that is equal to a height of the lower point above the curb's bottom surface; and wherein the outer edge of the panel and inward surface of the curb abut one another.

2. The shower pan installation kit of claim 1, wherein the panels and curbing are adhered one to another.

3. The shower pan installation kit of claim 1, wherein the curb and paneling are fabricated from polystyrene.

4. The shower pan installation kit of claim 1, wherein the groove rises upwardly at between 10 degrees and 70 degrees off horizontal.

5. A shower pan installation kit comprising:

a tray comprising a polymeric panel having a planar bottom surface and inwardly sloping concave top surface, wherein the tray defines a circular recess for receiving a drain;

a polymeric hexahedrial curb having a planar inward surface and planar bottom surface;

wherein the curb defines an upwardly rising groove recessed into the curb such that the groove rises from a lower point on the inward surface to a higher end point within the curb, the groove for subsequently receiving a waterproof membrane overlaying and overlapping the tray;

wherein an outer edge of the panel rises through a distance from the panel's bottom surface to the top surface that is equal to a height of the lower point of the curb above the curb's bottom surface; and wherein the outer edge of the panel and inward surface of the curb abut one another.

* * * * *